US006106022A

United States Patent [19]

Badash et al.

[11] Patent Number: 6,106,022

[45] Date of Patent: Aug. 22, 2000

[54] SYSTEM FOR DECORATING TEXTILE OR PAPER MATERIAL

[75] Inventors: Moshe Badash, Petach Tiqwa; Michael Krzepicki, Ramat Gan, both of Israel

[73] Assignee: Dora Embroidery Enterprises & Marketing (1982) Ltd., Ramat Gan, Israel

[21] Appl. No.: 08/418,833

[22] Filed: Apr. 7, 1995

[30] Foreign Application Priority Data

Apr. 7, 1994 [IL] Israel ..... 109256
Nov. 17, 1994 [IL] Israel ..... 111686

[51] Int. Cl.[7] ..... B42D 15/00

[52] U.S. Cl. ..... 283/81; 283/117

[58] Field of Search ..... 283/117, 81, 101, 283/79, 80; 40/630, 299; 428/40.1, 41.8, 42.2, 42.3, 41.9

[56] References Cited

U.S. PATENT DOCUMENTS

| | | | |
|---|---|---|---|
| 3,816,211 | 6/1974 | Haigh | 156/309 |
| 4,061,516 | 12/1977 | George | 156/94 |
| 4,163,817 | 8/1979 | DiCarlantonio | 428/33 |
| 4,845,778 | 7/1989 | Peterson | 2/24 |
| 4,860,387 | 8/1989 | Williams | 2/244 |
| 5,016,285 | 5/1991 | Just . | |
| 5,086,516 | 2/1992 | Baxter | 2/108 |
| 5,102,171 | 4/1992 | Saetre | 283/117 |
| 5,183,297 | 2/1993 | Bodziak et al. | 283/117 X |
| 5,190,316 | 3/1993 | Hefty | 283/117 X |
| 5,244,394 | 9/1993 | Serabian-Musto | 434/263 |
| 5,318,327 | 6/1994 | Daneshvar | 283/117 |
| 5,379,461 | 1/1995 | Wilmers | 2/115 |

FOREIGN PATENT DOCUMENTS 070727 1/1983 European Pat. Off. .

*Primary Examiner*—Willmon Fridie, Jr.
*Attorney, Agent, or Firm*—Ladas & Parry

[57] ABSTRACT

A system for decorating textile material comprising an article of textile material embellished with an ornamental design, and a decorative patch capable of being mounted on the article of textile material, the article of textile material further including a marked area for indicating a location of mounting for the patch.

26 Claims, 7 Drawing Sheets

SYSTEM FOR DECORATING TEXTILE OR PAPER MATERIAL

FIELD OF THE INVENTION

The present invention relates to a novel system for decorating textile or paper materials and, more particularly, to a novel system for decorating articles of clothing, such as shirts, or other items, such as greeting cards, with decorative patches.

BACKGROUND OF THE INVENTION

The use of patches to cover holes or worn out areas in clothing is well known. In recent years, decorative patches which can be attached to clothing have been manufactured and sold for the sole purpose of decorating articles of clothing, rather than for covering holes. These patches have various shapes and designs and frequently represent popular characters from the media. They are intended to be mounted on a piece of clothing at any location desired by the user.

Articles of clothing having pictures or designs imprinted on them, such as shirts, and particularly T-shirts, are also well known. However, if one desires to mount a decorative patch on such an article of clothing, the result will frequently be undesirable, since there is no compatibility between the patch and the picture on the clothing. Furthermore, not every person has the aesthetic sense necessary to produce a successful combination of patch and picture. It would therefore be desirable to have a system which would facilitate a satisfactory association between an embellished article of textile material such as an article of clothing and a decorative patch.

Various types of novelty greeting cards are known in the art. These include, for example, greeting cards which provide an audio message or music and cards which contain a scent. Cards are also known which include removable portions having use other than just as a card.

SUMMARY OF THE INVENTION

It is an object of the present invention to provide a system for facilitating the decoration of textile material by use of decorative patches.

It is a further object of the present invention to provide a system for integrating decorative patches with an ornamental design which embellishes an article of textile material.

According to one aspect of the present invention, there is provided a system for decorating textile material comprising an article of textile material embellished with an ornamental design, and a decorative patch capable of being mounted on the article of textile material, the article of textile material further including a marked area for indicating a location of mounting for the patch.

Further aspects of the invention will be understood from the example described below with reference to FIGS. 1–3.

The present invention also seeks to provide a novel greeting card.

There is thus provided in accordance with a preferred embodiment of the present invention a greeting card having removably attached on a face thereof a sticker, which can be removed from the card and subsequently adhered to another surface.

In accordance with a preferred embodiment of the present invention, the sticker comprises an embroidered patch which can be adhered to textile articles, such as clothing.

Alternatively, in accordance with a preferred embodiment of the present invention, the sticker comprises a paper or cellophane sticker, which may be opaque or transparent.

BRIEF DESCRIPTION OF THE DRAWINGS

The present invention will be better understood from the following detailed description of a preferred embodiment, taken in conjunction with the following drawings in which.

DETAILED DESCRIPTION OF A PREFERRED EMBODIMENT

Figure 1:
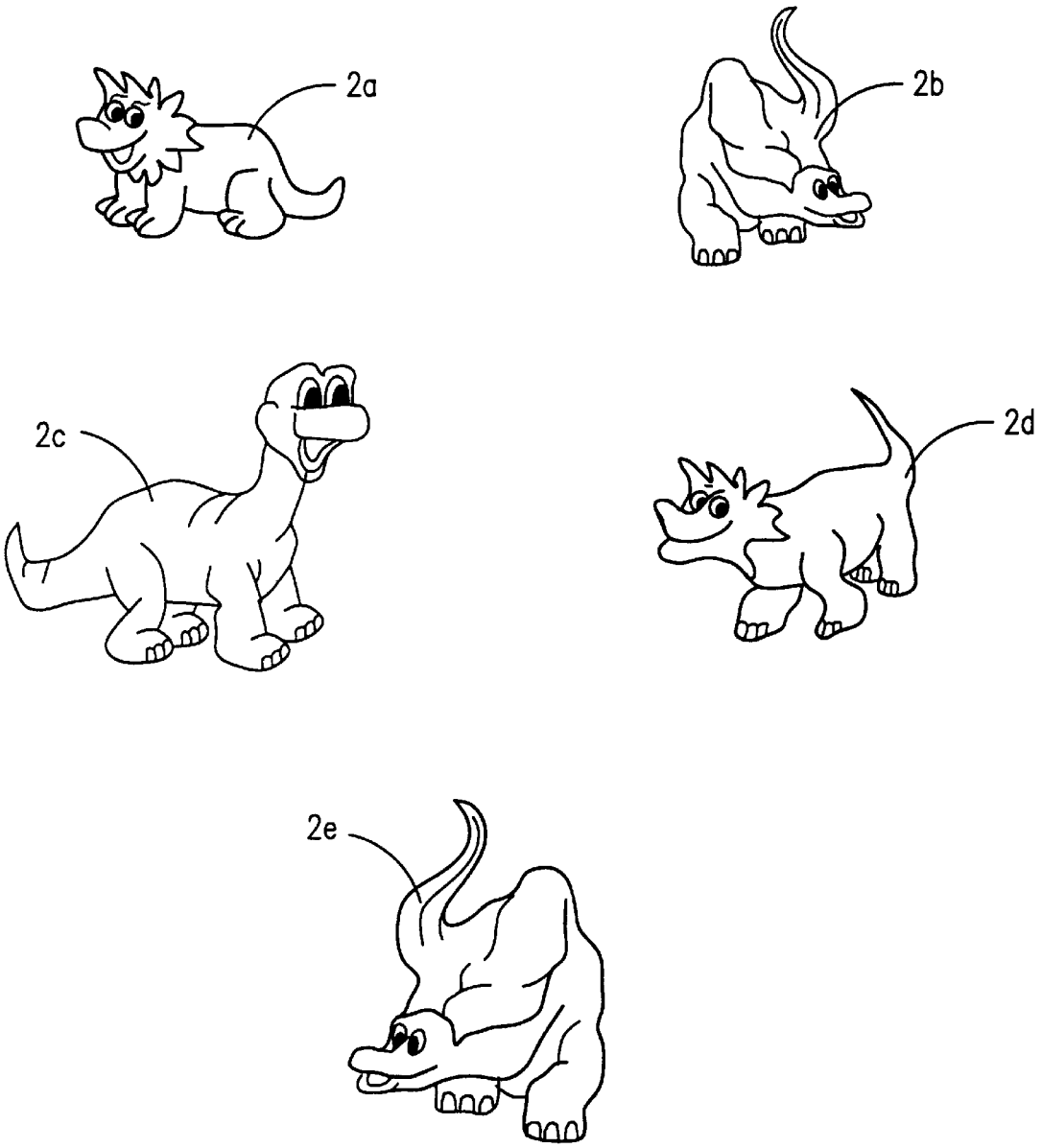
FIG. 1 is a plan view of a number of decorative patches in accordance with a preferred embodiment of the invention.

Reference is now made to FIG. 1, in which are illustrated a number of decorative patches 2*a*–2*e*. The patches of the invention may be made of any material capable of being mounted on textile material. Such materials include, for example, cloth and synthetic fibers, separately or in combination, and plastics. The patches may be produced by any of the known methods for producing patches, including the method of transfer-print. Methods of mounting or attaching the patches to textile material are well known, and include ironing-on, sewing-on, and sticking-on using various type of gluing reagents, as is known to the average skilled man of the art.

As can be further seen in FIG. 1, the decorative patches of the preferred embodiment may depict popular characters portrayed in the media. It is to be understood that the patches of the invention can depict any object such as an inanimate article, person, animal, plant or design, as long as the resulting patches are decorative.

Figure 2:
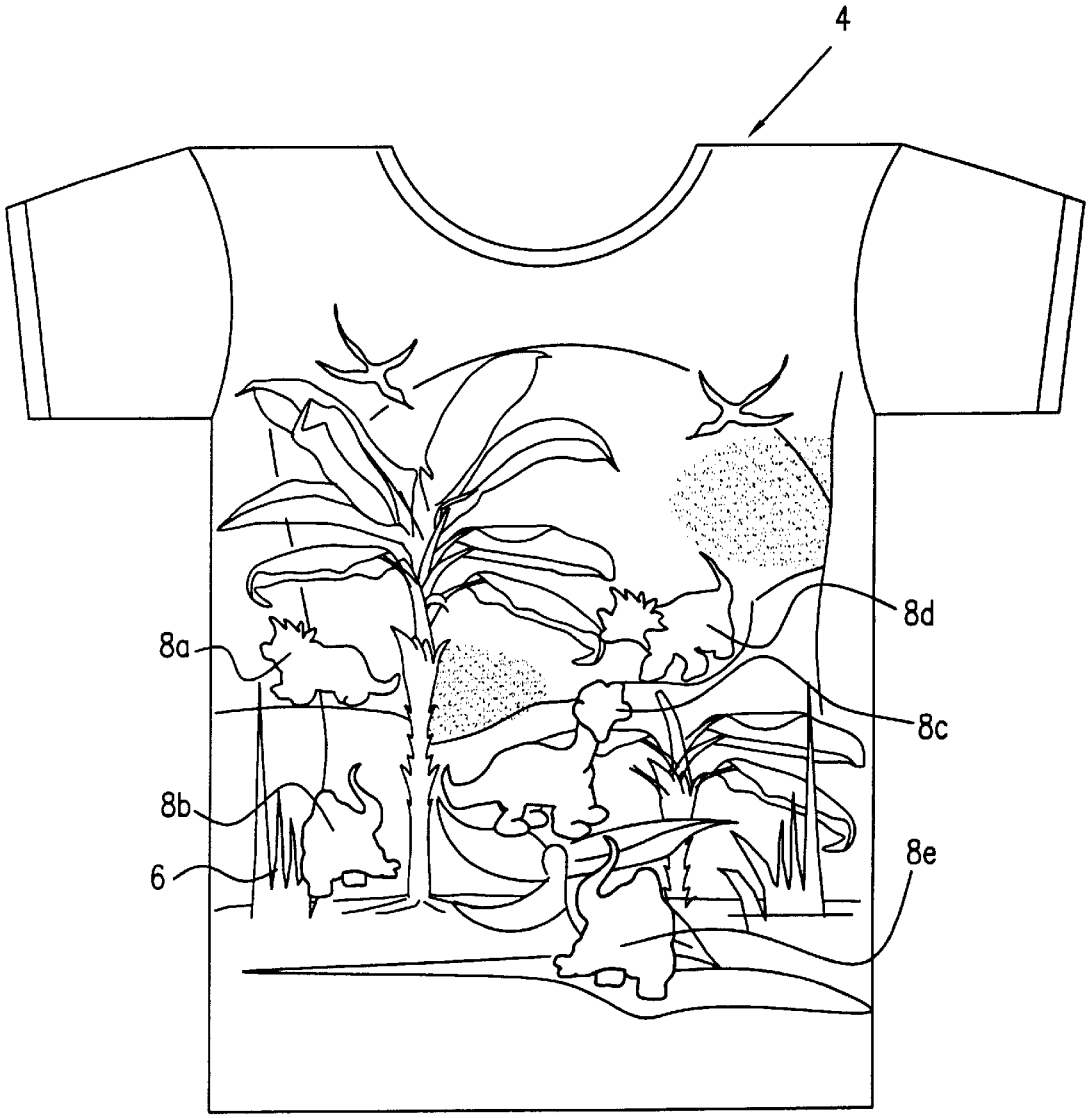
FIG. 2 is a plan view of a T-shirt in accordance with a preferred embodiment of the invention.

Referring now to FIG. 2, there is illustrated a T-shirt 4 embellished with a picture 6.

Although the preferred embodiment of the system of the invention utilizes a T-shirt, it is to be understood that the invention can be applied to all types of textile material and clothing whose appearance would be enhanced by the addition of a decorative patch. These include shirts, pants, hats, coats, skirts and dresses, table cloths, curtains, etc. The term "textile material" is well known in the art and includes all types of woven or knit cloth, synthetic and non-synthetic fibers, yarn, etc.

The picture 6 of the preferred embodiment is printed on the T-shirt 4 in a known manner, and may depict a setting from a recent movie. However, the ornamental design of the invention is not limited to pictures, but may include any composition, drawing or design appearing on the textile material, principally for decorative purposes. The design may be applied to the textile material in any of the known manners of application.

Further illustrated in FIG. 2 are a number of areas 8*a*–8*e*, which appear as outlines of shapes substantially similar, respectively, to the shapes of the decorative patches of FIG. 1. Thus, area 8*a* is similar in shape to decorative patch 2*a*, area 8*b* is similar to 2*b*, etc. Although in the preferred embodiment the areas 8*a*–8*e* are located within and form a part of the picture 6, the areas may be situated at any location on the textile material proximate to the picture so that the decorative patches placed on the areas relate to the design and complement it. In the preferred embodiment, the areas have been printed on a T-shirt already embellished with a picture. It is of course possible to print the areas on the material together with or prior to the printing of the picture or design.

Figure 3:
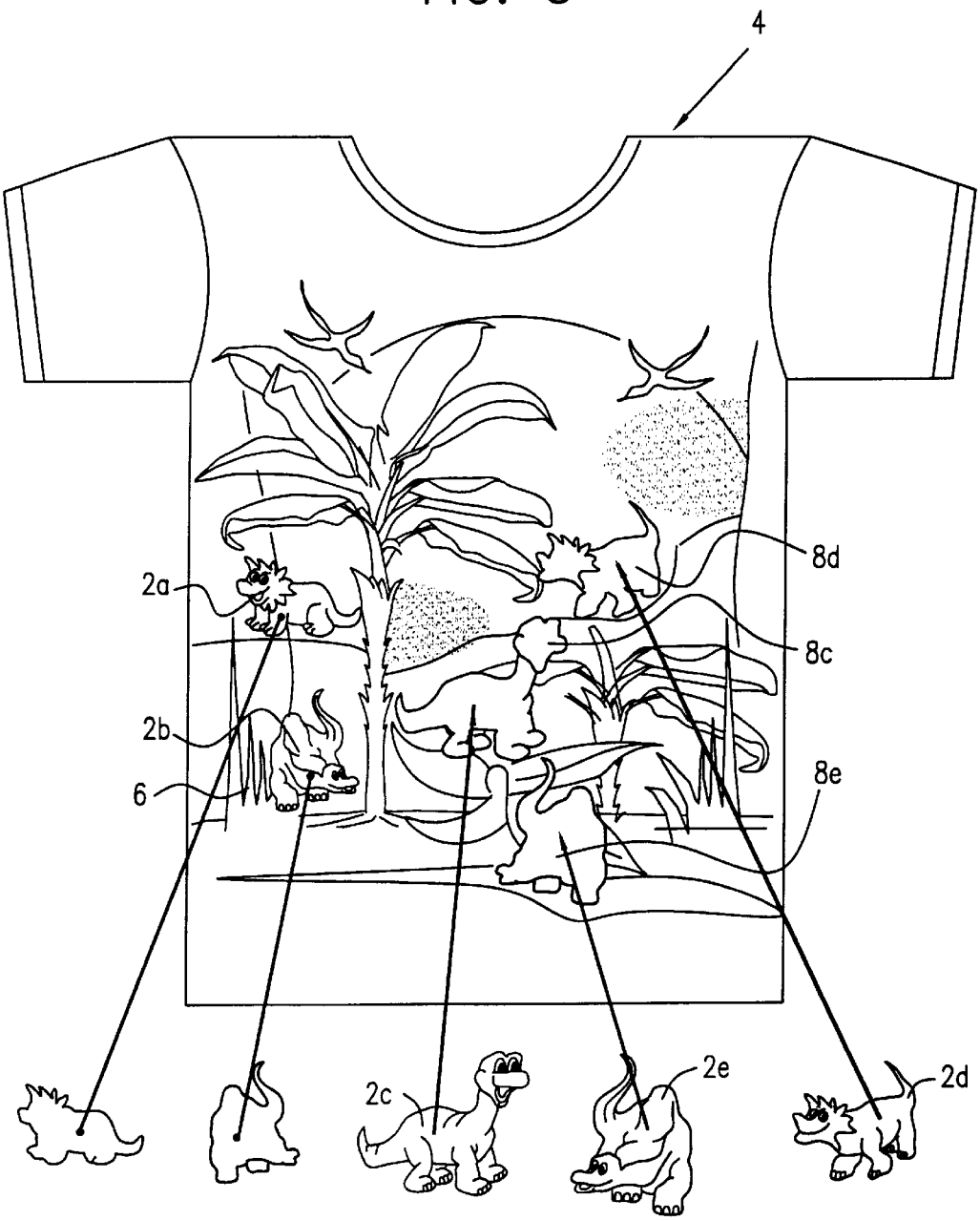
FIG. 3 illustrates a preferred embodiment of the system of the invention employing the decorative patches of FIG. 1 and the T-shirt of FIG. 2.

The operation of the system of the invention will now be described with reference to FIG. 3, which illustrates the T-shirt 4 and the decorative patches 2*a*–2*e*. It can be seen that patches 2*a* and 2*b* have already been mounted on areas 8*a* and 8*b*, respectively, while patches 2*c*–2*e* have not as yet been mounted on areas 8*c*–8*e*, respectively. The areas 8*a*–8*e* have been situated so that when the patches 2*a*–2*e* are mounted on them, the result is a picture in which the patches harmonize with the background design in a manner pleasing to the eye. Although the system of the example employs 5 patches and 5 corresponding areas, it is readily apparent that any number of patches and corresponding areas may be used.

Figure 4:
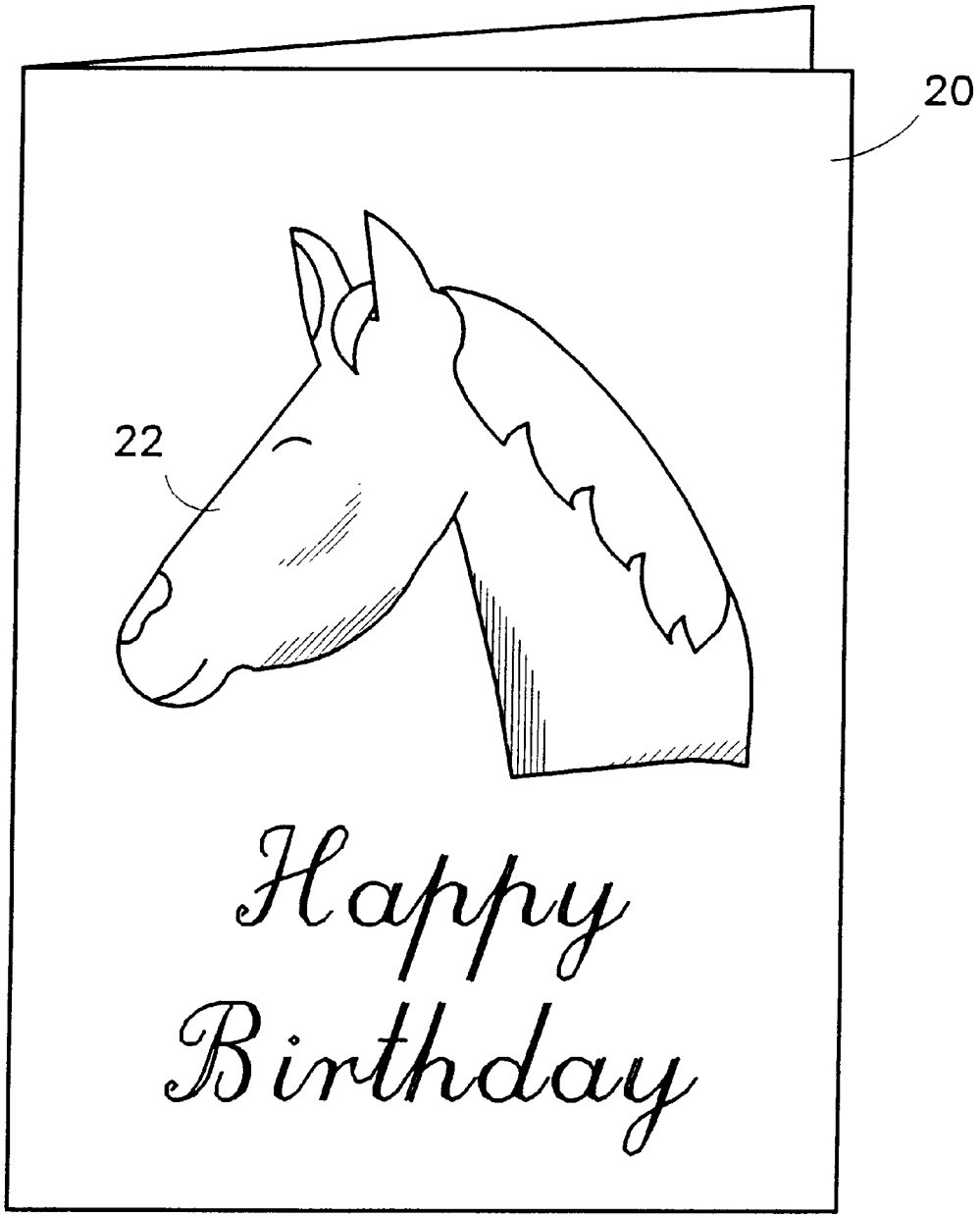
FIG. 4 is a pictorial illustration of a greeting card including a sticker, in accordance with a preferred embodiment of the present invention.

Reference is now made to FIG. 4, which illustrates a greeting card 20 constructed and operative in accordance with a preferred embodiment of the present invention and including a sticker 22 removably attached to the front face thereof. In accordance with a preferred embodiment of the present invention, the sticker is formed of fabric and is embroidered. Alternatively, any other suitable type of removably attachable sticker may be employed.

Figure 5:
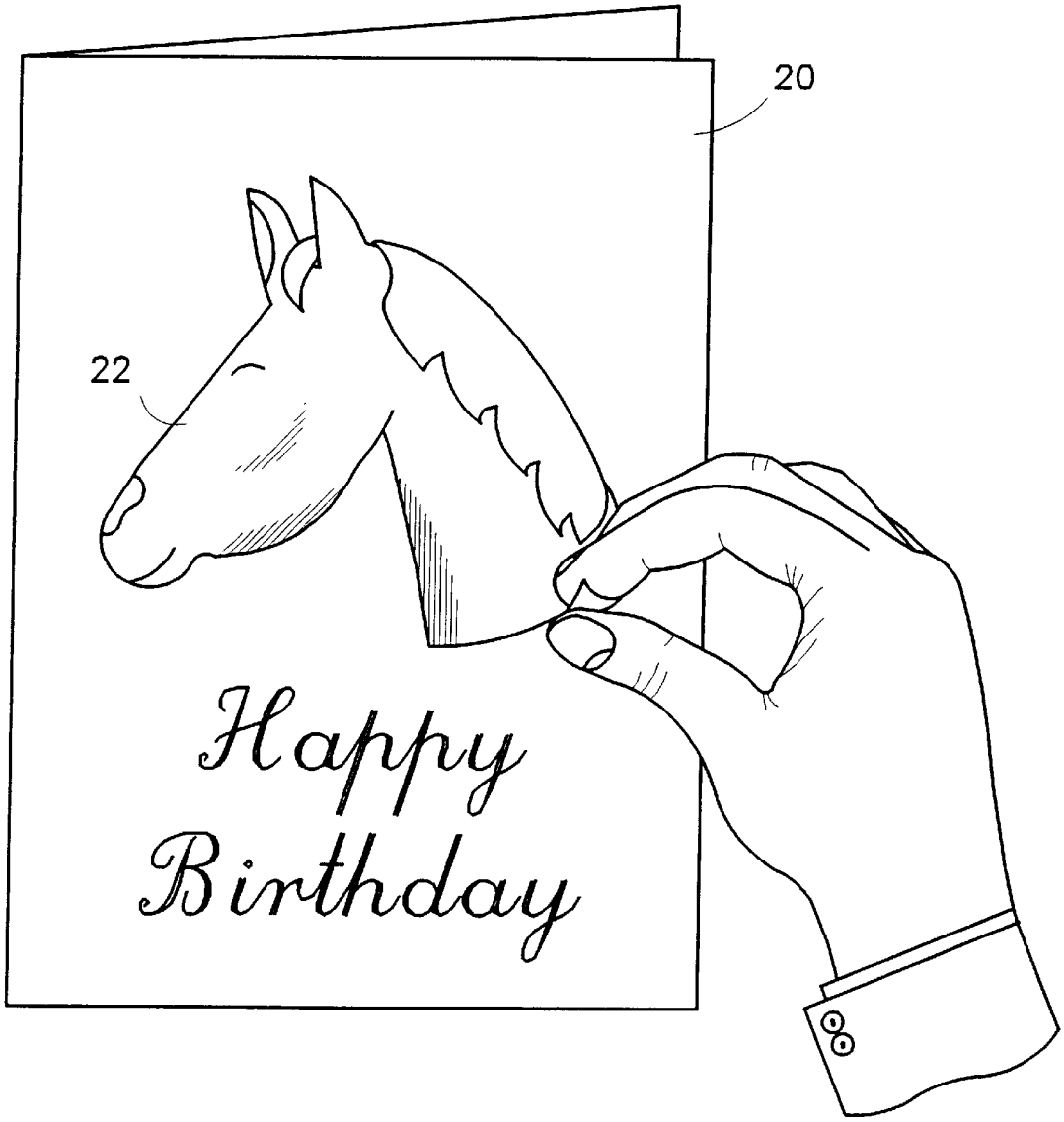
FIG. 5 is a pictorial illustration showing removal of the sticker from the greeting card of FIG. 4.
Figure 6:
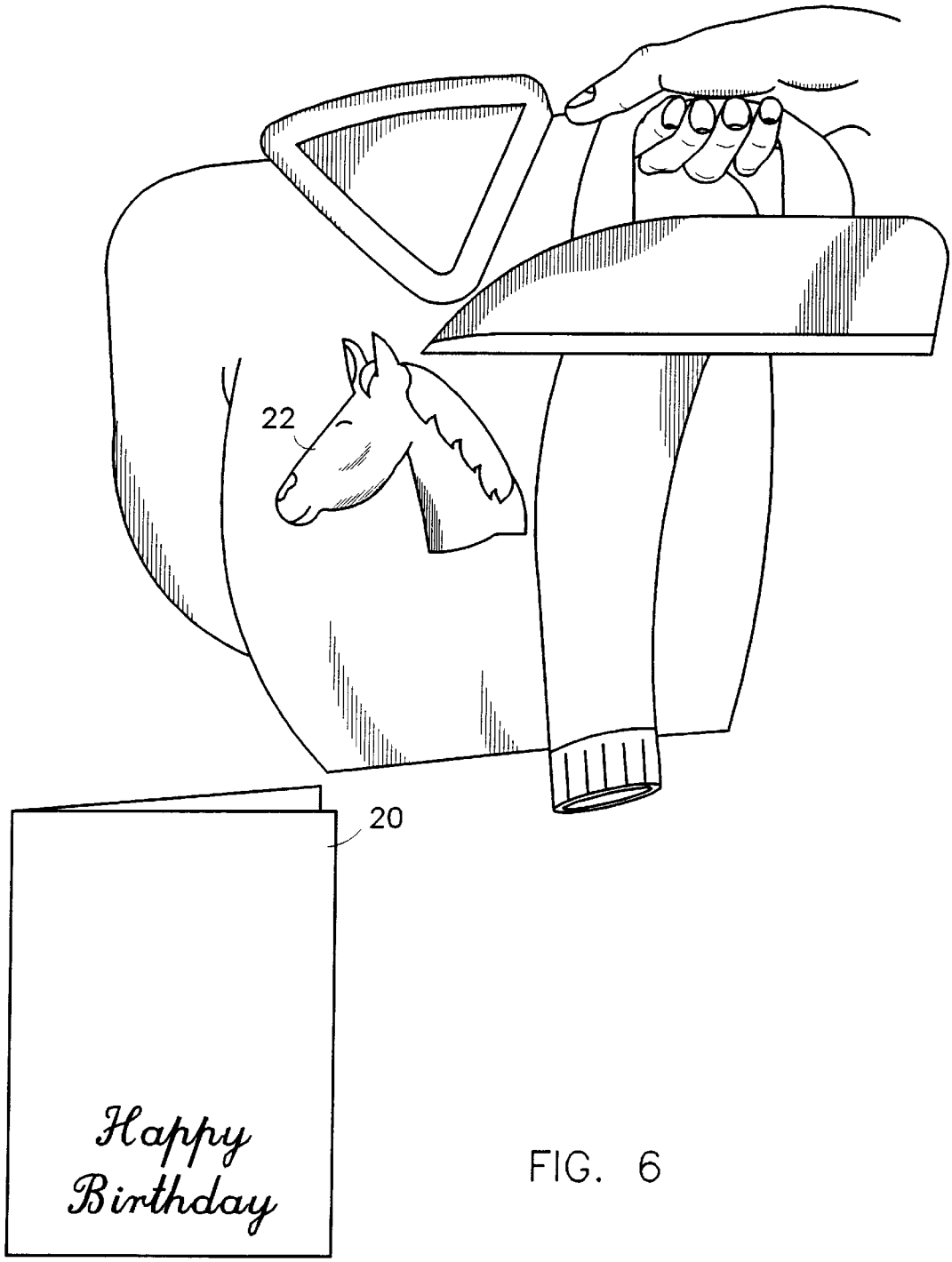
FIG. 6 is a pictorial illustration of attachment of a sticker to textile material.

Typically, the sticker 22 is attached to the front face of the card by means of a first adhesive, such as for example, rubber cement, which provides removable adhesion of the sticker to the face of the card. In accordance with a preferred embodiment of the present invention, the sticker also includes a second adhesive, preferably different from the first adhesive, which can be used for permanent, semi-permanent or temporary adhesion of the sticker, once it has been removed from the card, as seen in FIG. 5, onto another object, such as an item of clothing, as shown in FIG. 6.

In accordance with a preferred embodiment of the invention, the second adhesive may be a heat actuated adhesive, as for an iron-on embroidered fabric sticker. Alternatively, the second adhesive may be a water activated adhesive, such as that used in decals. Any other suitable adhesive may be employed.

Figure 7:
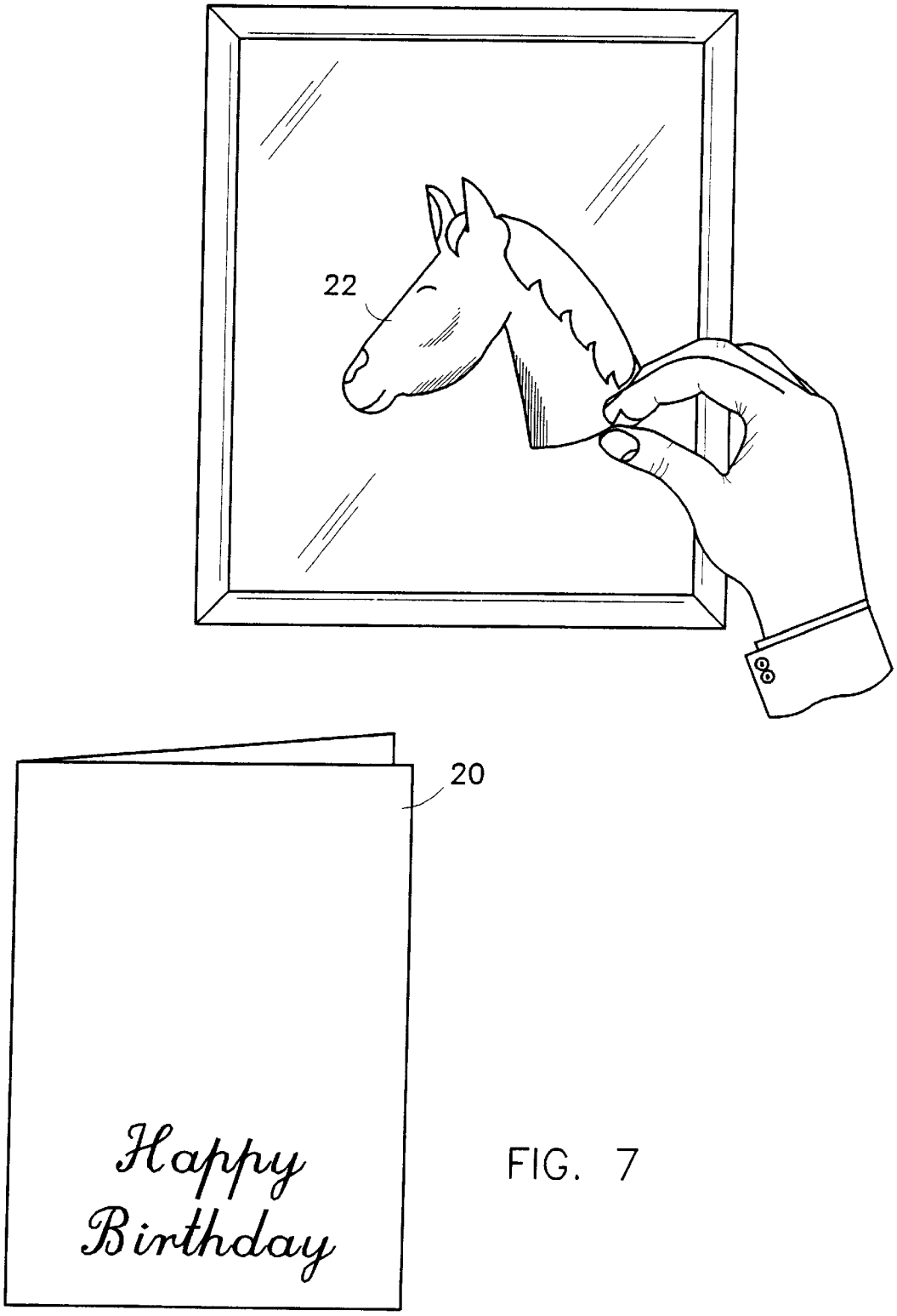
FIG. 7 is a pictorial illustration of attachment of a sticker to a smooth surface of an article.

FIG. 7 illustrates adherence of the sticker when removed from the card onto a smooth surface of an object, such as a window.

Various modifications of the invention in addition to those shown and described herein will become apparent to those skilled in the art. The scope of the invention is not to be construed as limited by the illustrative embodiments set forth herein, but is to be determined in accordance with the appended claims.

We claim:

1. A system for decorating textile material comprising:

an article of textile material embellished with an ornamental design, and a decorative patch capable of being mounted on said article of textile material, said article of textile material further including a marked area for indicating a location for mounting said patch.

2. A system according to claim 1 wherein said decorative patch depicts an object.

3. A system according to claim 1 wherein said ornamental design is a picture.

4. A system according to claim 1 wherein said area is substantially similar in shape to said patch.

5. A system according to claim 1 wherein said article of textile material is a part of an article of clothing.

6. A system according to claim 5 wherein said article of clothing is a shirt.

7. A system according to claim 1 wherein said decorative patch is an iron-on patch.

8. A system according to claim 6 wherein said decorative patch is a sew-on patch.

9. A system according to claims 6 wherein said decorative patch is a stick-on patch.

10. A system according to claim 1 wherein said area is proximate to said ornamental design.

11. A system according to claim 10 wherein said area forms a part of said ornamental design.

12. A system according to claim 1 comprising a plurality of said decorative patches and a corresponding plurality of said areas.

13. A greeting card having removably attached on a face thereof a sticker, which can be removed from the card and subsequently adhered to another surface, and wherein the sticker formed with first and second different adhesives.

14. A greeting card according to claim 13 and wherein the sticker can be adhered to textile articles, such as clothing.

15. A greeting card according to claim 13 and wherein said first adhesive is a removably adhering adhesive.

16. A greeting card according to claim 13 and wherein said second adhesive is a permanently adhering adhesive.

17. A greeting card according to claim 13 and wherein said second adhesive is a semi-permanently adhering adhesive.

18. A greeting card according to claim 13 and wherein said second adhesive is a temporarily adhering adhesive.

19. A greeting card according to claim 13 and wherein the sticker comprises a paper or cellophane sticker.

20. A greeting card according to claim 13 and wherein the sticker comprises an embroidered patch.

21. A system for decorating textile material according to claim 1 wherein said patch comprises a non-quadrilateral patch.

22. A system according to claim 1 wherein said marked area corresponds in size and in shape to said patch.

23. A system according to claim 1 wherein the decorative patch relates to the design and complements the design.

24. A system for decorating textile material comprising:

an article of textile material embellished with an ornamental design, and a decorative patch capable of being mounted on said article of textile material, said ornamental design further including a marked area for indicating a location for mounting said patch.

25. A system for decorating textile material comprising:

an article of textile material;

a plurality of decorative patches capable of being mounted on said article of textile material:

wherein the article of textile material includes a marked area for indicating a plurality of locations for mounting said plurality of patches respectively and wherein said plurality of patches, when mounted on said article of textile material at said plurality of locations, together form at least a portion of an ornamental design.

26. A greeting card having removably mounted on a face thereof a sticker, which can be removed from the card and subsequently mounted at another location, and wherein the sticker includes a first mounting element whereby the sticker is removably mountable on the card and a second mounting element whereby the sticker is mountable at another location.

* * * * *